US007785210B2

(12) United States Patent
Lee

(10) Patent No.: US 7,785,210 B2
(45) Date of Patent: Aug. 31, 2010

(54) WRIST PROTECTION DEVICE FOR BOWLING GAME

(76) Inventor: Mi-Ja Lee, 105-Yonghyeon Jutack, 150-19 Yonghyeon-dong, Nam-gu, Incheon 402-020 (KR)

( * ) Notice: Subject to any disclaimer, the term of this patent is extended or adjusted under 35 U.S.C. 154(b) by 448 days.

(21) Appl. No.: 11/919,642

(22) PCT Filed: Jul. 27, 2006

(86) PCT No.: PCT/KR2006/002944

§ 371 (c)(1),
(2), (4) Date: Oct. 31, 2007

(87) PCT Pub. No.: WO2007/123291

PCT Pub. Date: Nov. 1, 2007

(65) Prior Publication Data

US 2010/0075770 A1 Mar. 25, 2010

(30) Foreign Application Priority Data

Apr. 22, 2006 (KR) ..... 20-2006-0010862

(51) Int. Cl.
*A63B 69/00* (2006.01)
*A63F 5/04* (2006.01)

(52) U.S. Cl. ..... 473/62; 2/162; 482/45; 602/16; 602/21

(58) Field of Classification Search ..... 473/61–63; 2/16, 20, 159, 160, 161.1, 162, 163, 170; 602/5, 16, 21
See application file for complete search history.

(56) References Cited

U.S. PATENT DOCUMENTS

| | | | | |
|---|---|---|---|---|
| 4,666,158 | A * | 5/1987 | Moro | 473/62 |
| 5,163,678 | A * | 11/1992 | Rogers | 473/59 |
| 5,466,192 | A * | 11/1995 | Castolo et al. | 473/62 |
| 6,827,653 | B2 * | 12/2004 | Be | 473/62 |
| 7,043,769 | B2 * | 5/2006 | Chung | 2/161.1 |
| 2004/0185950 | A1 * | 9/2004 | Be | 473/62 |
| 2007/0105636 | A1 * | 5/2007 | Chung | 473/62 |

* cited by examiner

*Primary Examiner*—William M Pierce
(74) *Attorney, Agent, or Firm*—Robert E. Bushnell, Esq.

(57) ABSTRACT

A wrist protection device for a bowling game is disclosed, which comprises a wrist mounted plate, an adjusting pin which connects an intermediate plate and includes an apex, a concave portion and a support, an ascending and descending plate which ascends and descends in an interior of the casing attached to an upper surface of the intermediate plate based on an operation of a button and spring, and a moving member which slides along the guide members of the ascending and descending plate.

2 Claims, 5 Drawing Sheets

【Figure 1】
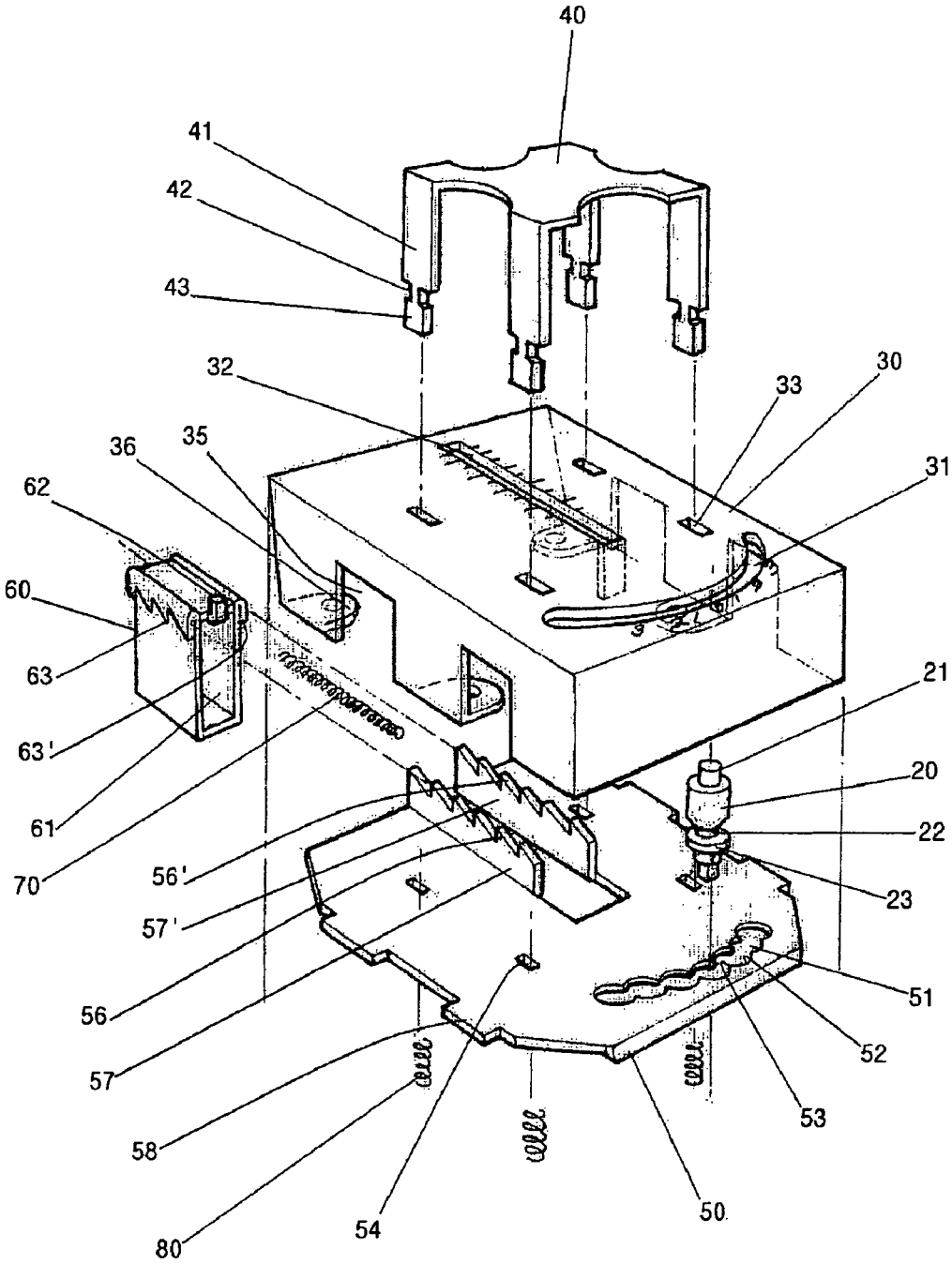

【Figure 2】
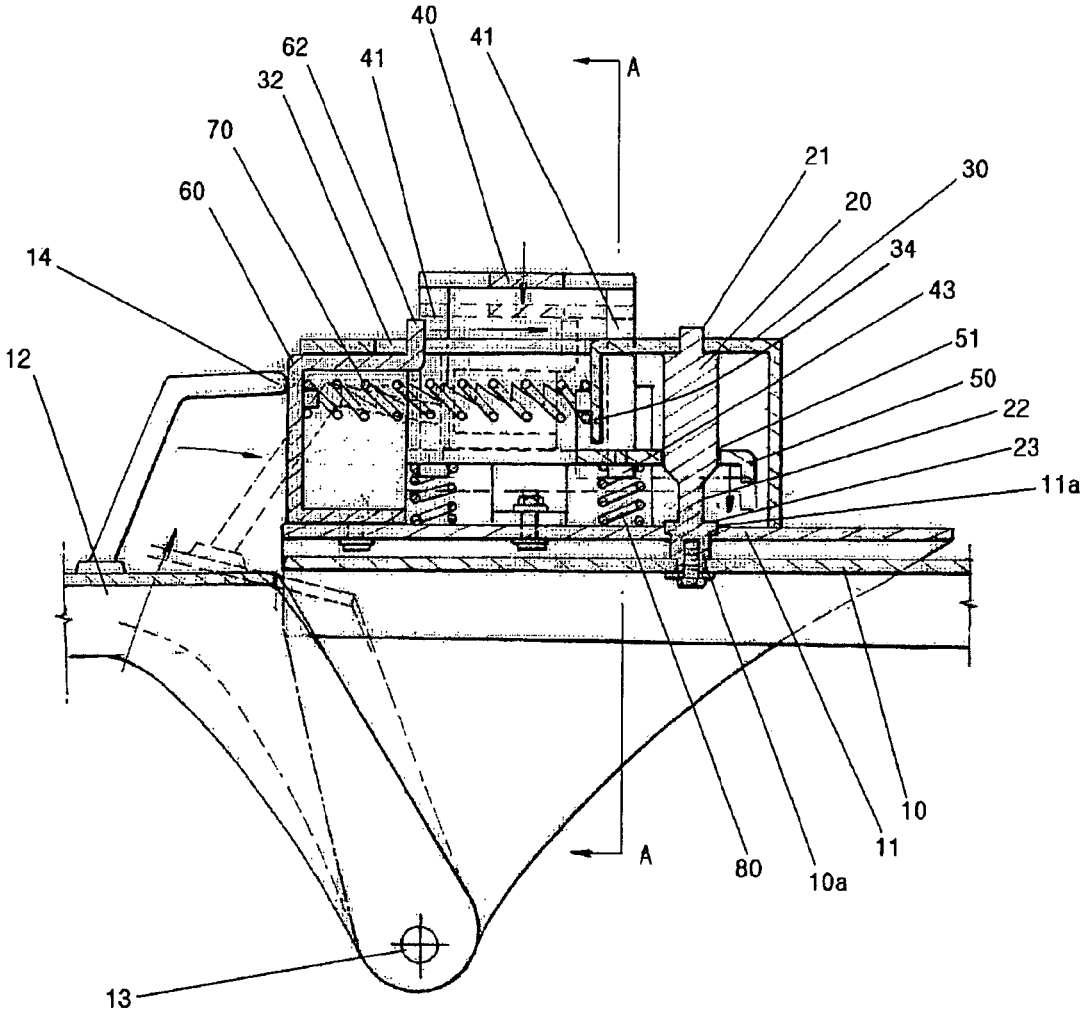

【Figure 3】
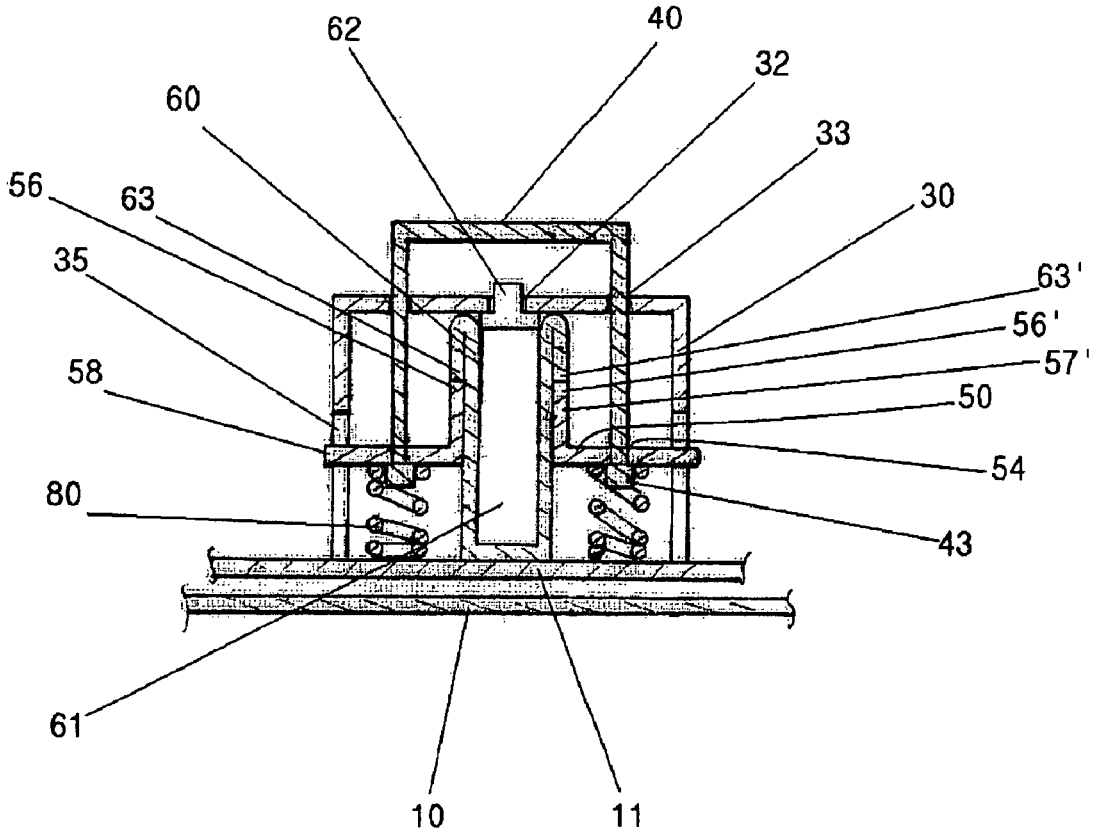

【Figure 4】
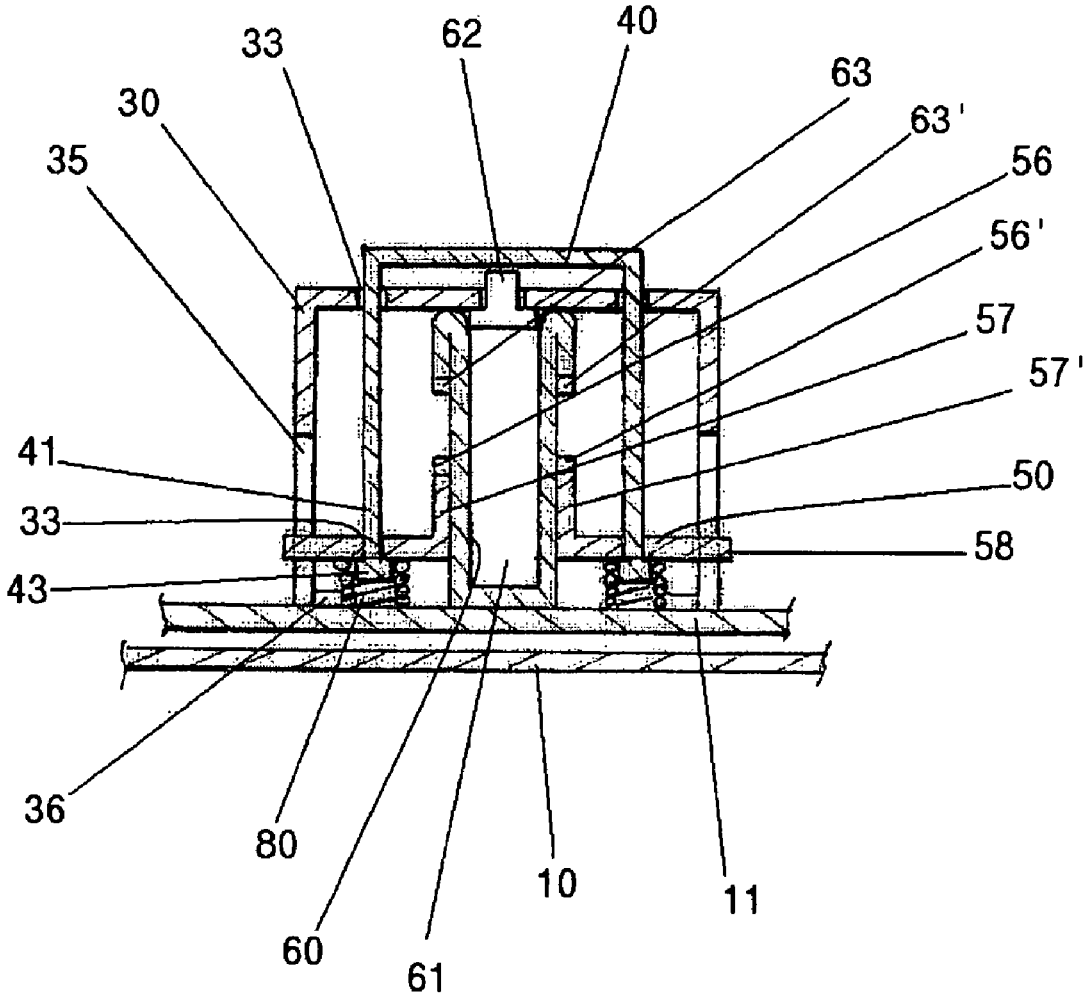

【Figure 5】
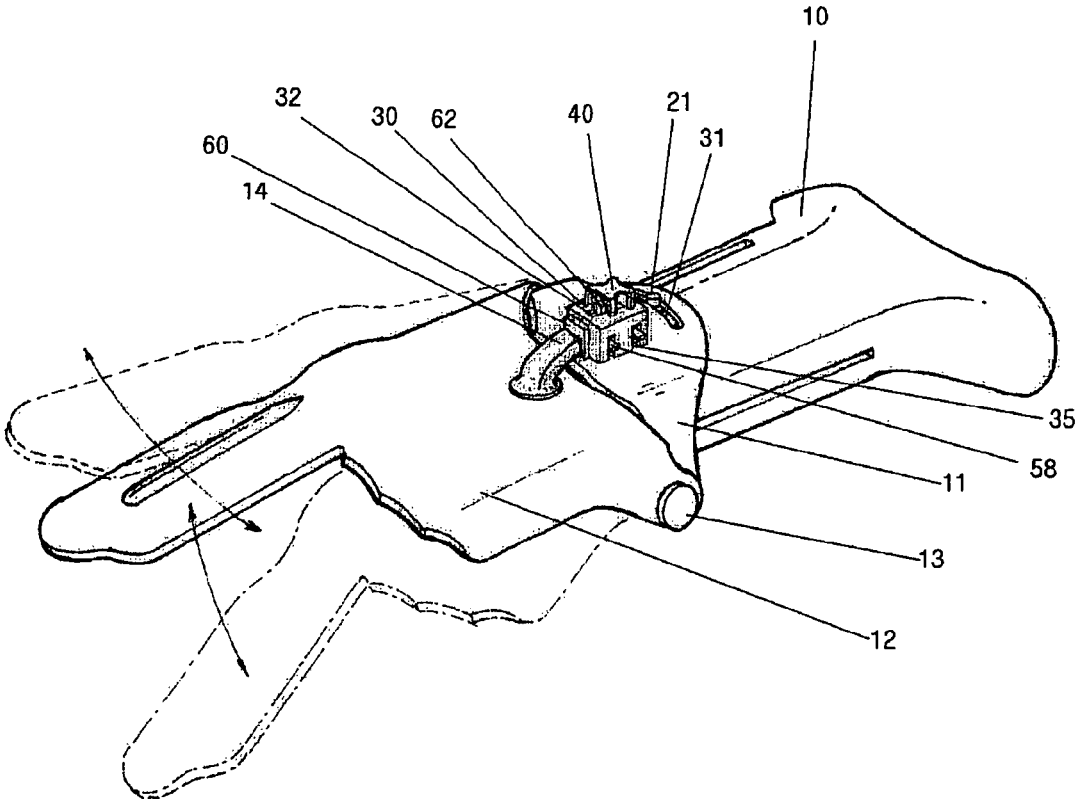

WRIST PROTECTION DEVICE FOR BOWLING GAME

CLAIM OF PRIORITY

This application makes reference to, incorporates the same herein, and claims all benefits accruing under Title 35 U.S. Code §365(b)(c) of my PCT International application entitled WRIST PROTECTION DEVICE FOR BOWLING GAME, filed on Jul. 27, 2006 and duly assigned Serial No. PCT/KR2006/002944.

TECHNICAL FIELD

The present invention relates to a wrist protection device for a bowling game in which a player can stably release a heavy bowling ball, and in particular to a wrist protection device for a bowling game in which an intermediate plate is provided at a front end of a wrist mounted plate worn at a wrist using a band, and a hand back support plate is connected at both ends of the intermediate plate using pins. An apex part connects the wrist mounted plate and the intermediate plate, and an adjusting pin includes a concave portion and a support. An ascending and descending plate ascends and descends at a casing attached to an upper surface of the intermediate plate by a button. A mobbing member stops and slides as the ascending and descending plate ascends and descends. With the above construction, as the button is pressed, the ascending and descending plate descends and escapes from the restriction of the adjusting pin and allows the intermediate plate to rotate in a horizontal direction. As the ascending and descending plate descends, in a state that the moving member is stopped, it moves backward or forward, so that the vertical and horizontal angles of the hand back support plate can be concurrently adjusted by adjusting the hand back support plate in a vertical direction.

BACKGROUND ART

In a conventional art, a hand back support plate tied by a hand using a band at an intermediate plate, which is connected at a front end of a wrist mounted plate rotatably in left and right directions, is connected rotatably in a vertical direction, with the wrist mounted plate being mounted at a wrist using a band. A horizontal angle adjusting member is provided for adjusting a horizontal angle of the intermediate plate with respect to a wrist mounted plate, and a vertical angle adjusting member is provided for adjusting a vertical angle of the hand back support plate. The horizontal and vertical angle adjusting members are mounted on an upper surface of the intermediate plate. A bowling player wears the above device at a wrist and plays a bawling game while adjusting the horizontal and vertical angles of the hand back support plate while the player releases first and second times. However, in the conventional art, so as to adjust the horizontal angle of the hand back support plate, it is needed operate the horizontal angle adjusting member with the other hand which does not wear the above device, and the horizontal angle of the hand back support plate is adjusted as the intermediate plate is rotated, and then the vertical angle adjusting member is operated for thereby adjusting the vertical angle of the hand back support plate. In the conventional art, the angle adjusting work is too complicated, and the horizontal and vertical angle adjusting members are separately provided. So, the construction of the entire system is so complicated, and the volume is too large. The manufacture cost increases, and the product is expensive and too heavy.

DISCLOSURE

Technical Problem

Accordingly, it is an object of the present invention to provide a wrist protection device for a bowling game which overcomes the problems encountered in the conventional art.

It is another object of the present invention to provide a wrist protection device for a bowling game in which the horizontal and vertical angles of an intermediate plate and a hand back support plate can be easily adjusted with respect to a wrist mounted plate using only one button while achieving a simple construction.

Technical Solution

To achieve the above objects, there is provided a wrist protection device for a bowling game which comprises a wrist mounted plate, an adjusting pin which connects an intermediate plate and includes an apex, a concave portion and a support, an ascending and descending plate which ascends and descends in an interior of the casing attached to an upper surface of the intermediate plate based on an operation of a button and spring, and a moving member which slides along the guide members of the ascending and descending plate. With the above construction, when a button is pressed, the ascending and descending plate descends and is escaped from a restriction of the adjusting pin and allows the intermediate plate to become a rotatable state. When the moving member is escaped from the engaging teeth formed at the guide members of the ascending and descending plate. So, the horizontal and vertical angles of the hand back support plate are concurrently adjusted for a good release of a bowling ball by moving a wrist as the front end of the bent rod of the hand back support plate adjusts the moving member.

ADVANTAGEOUS EFFECTS

In the present invention, it is possible to concurrently adjust the horizontal and vertical angles of the hand back support plate 12 by simply pressing the button 40 for a proper angle of a good release of the bowling ball. It is very easy to adjust the vertical and horizontal angles of the same as compared to the conventional art in which the vertical and horizontal angles of the same are adjusted by operating a lever of the vertical and horizontal angle adjusting members. The construction is simple, and the manufacture cost is low. The product is light, so that it is possible to easily handle without interfering with the releasing procedure of the bowling ball.

DESCRIPTION OF DRAWINGS

FIG. 1 is a disassembled perspective view illustrating a wrist protection device for a bowling game according to the present invention;

FIG. 2 is an assembled vertical cross sectional view illustrating a wrist protection device for a bowling game according to the present invention;

FIG. 3 is a cross sectional view taken along line A-A of FIG. 2;

FIG. 4 is a cross sectional view of an operation example of FIG. 3; and

FIG. 5 is a view illustrating the adjustments of the angles with a dashed line and a dotted line by attaching to a wrist protection device according to the present invention.

BEST MODE

FIG. 1 is a disassembled perspective view illustrating a wrist protection device for a bowling game according to the present invention. FIG. 2 is an assembled vertical cross sectional view illustrating a wrist protection device for a bowling game according to the present invention. FIG. 3 is a cross sectional view taken along line A-A of FIG. 2. FIG. 4 is a cross sectional view of an operation example of FIG. 3. FIG. 5 is a view illustrating the adjustments of the angles with a dashed line and a dotted line by attaching to a wrist protection device according to the present invention.

As shown therein, an intermediate plate 11 is rotatable in left and right horizontal directions with respect to a wrist mounted plate 10 by connecting a wearing plate 10 and an intermediate plate 11 using a pin. A hand back support plate 12 is rotatable in up and down vertical directions with respect to the intermediate plate 11 using a pin 13. In the present invention, an adjusting pin 20 is used instead the conventional pin for connecting the intermediate plate 11 at the wrist mounted plate 10 rotatably in left and right directions. An apex 21 is formed at an upper side of the adjusting pin 20 according to the present invention, and a concave portion 22 being slimmer than the body of the adjusting pin 20 is formed at the intermediate portion, and a support 23 is formed below the concave portion 22. As shown in FIG. 2, the lower end of the adjusting pin 20 passes through so that the support 23 is placed on the hole 11*a* formed at the intermediate plate 11, and the lower end of the adjusting pin 20 is inserted into the hole 10*a* formed at the wrist mounted plate 10, and the adjusting pin 20 is fixed at the wrist mounted plate 10 using a washer and nut, so that the intermediate plate 11 is rotatable with respect to the wrist support plate 10 in left and right horizontal directions.

In the drawings, reference numeral 30 represents a casing which becomes the body of the present invention. Scales are formed on an upper surface of the casing 30. In the above casing, a smooth concave elongated hole 31 having the same width as the thickness of the apex 21 of the adjusting pin 20 is provided. A straight adjusting hole 32 having scales and narrow width is provided, and four button holes 33 are formed. A spring support 34 is formed at an inner lower surface of the adjusting hole 32, and two ascending and descending grooves 35 are formed at left and right side surfaces of the casing 30.

The casing 30 is attached to an upper surface of the intermediate plate 11 using a bolt in such a manner that a hole is formed at a bent piece 36 which is formed by bending a lower end in which the ascending and descending groove 34 is formed.

In the drawings, reference numeral 40 represents a button. In the button 40, a longitudinal leg 41 is formed at each lower surface of four corners of the flat plate. Each leg 41 is provided with a groove 42 at a lower end, and a distortion support 43 which is formed at a lower side of the groove 42 and has a certain width less than the width of the leg 41. Each leg 41 passes through the button hole 33 of the casing 30. The ascending and descending plate 50 is connected with the leg 41 passing through the interior of the casing 30. A horizontal angle adjusting hole 51 is formed at one side of the ascending and descending plate 50 to match with the upper and lower ends of the smooth concave elongated hole 31 formed at the casing 41. In the horizontal angle adjusting hole 51, a groove moving part 53 is continuously arranged and punched in a shape of calabash shape so that it passes through the fixing hole 52 having the same inner diameter as the thickness of the adjusting pin 20 and the concave portion 22. A leg fixing hole 54 being narrower than the button hole 33 of the casing 30 and having the same width as the width of the distortion support 43 is punched at the ascending and descending plate 50. Guide members 57 and 57' having a plurality of engaging teeth 56 and 56'? are formed at the inner side of the groove 55 formed at the ascending and descending plate 50, and two ascending and descending guides 58 are formed at the left and right sides of the ascending and descending plate 50. The moving member 60 slides along the guide members 57 and 57' and includes a protrusion 62 at an upper side of an inner space 61, and moving engaging teeth 63 and 63' at an upper side of the left and right sides. With the above construction, the moving member 60 is slidably inserted between the guide members 57 and 57' through the groove 55 so that the moving engaging teeth 63 and 63' are engaged by the engaging teeth 56 and 56'. The straight spring 70 is engaged between the moving member 60 and the spring support 34 so that the moving member 60 is outwardly pushed by the elastic force of the straight spring 70.

The ascending and descending plate 50, which inserts the moving member 60 between the guide members 57 and 57' is engaged at a lower end of the leg 41 which passes through the interior of the casing 30. The ascending and descending guide 58 is inserted at the ascending and descending groove 35 and ascends and descends along the same, and the distortion support 43 of the lower end of each leg 41 passes through each leg fixing hole 54 of the ascending and descending plate 50, so that the lower end of the leg 41 closely contacts with the upper surface of the leg fixing hole 54. In this state, the distortion support 45 is forcibly distorted for connecting the ascending and descending plate 50 to the lower end of the leg 41. At this time, the protrusion 62 of the moving member 60 is exposed to the outside through the adjusting hole 32 having scales. When the casing 30 having the ascending and descending plate 50 is attached to the upper surface of the intermediate plate 11 using a bolt, the adjusting pin 20 protruded from the upper surface of the intermediate plate 11 passes through the horizontal angle adjusting hole 51 of the ascending and descending plate 50, and the apex 21 passes through the smooth concave elongated hole 31 of the casing 30 and is exposed to the outside. In this state, the casing 21 is placed on the upper surface of the intermediate plate 11, and the casing 30 is attached to the intermediate plate 11 using a bolt.

FIG. 5 is a view illustrating an outer construction when the casing 30 is attached to the intermediate plate 11. At this time, the upper end of the bent rod 14 attached to the upper side of the hand back support plate 12 contacts with an outer surface of the moving member 60, so that the vertical angle of the hand back support plate 12 is determined with respect to the wrist mounted plate 10.

With the above construction according to the present invention, when a player plays a bowing game, the wrist mounted plate 10 is mounted at a wrist ankle, and the hand back support plate 12 is mounted on the back of the hand using a band while covering the back of the hand for thereby easily lifting the bowing ball. When it is needed to adjust the angle of the wrist based on the ball releasing direction during the game, the button 40 is pressed with the other hand which does not wear the device. When the button 40 is pressed, the ascending and descending plate 50 descends, and the moving member 60 does not move since it contacts with the upper surface of the intermediate plate 11. Namely, only the ascending and descending plate 50 descends. As the ascending and descending plate 50 descends, the engaging teeth 56 and 56' descend and are separated from the moving engaging teeth 63 and 63' of the moving member 60, so that the moving member 60 becomes free from the controls of the engaging teeth 56 and 56'. The moving member 60 is pushed toward the bent rod 14 by moving the wrist, so that the moving member 60 is pushed outwardly based on the elastic force of the straight spring 70. The moving member 60 is stopped at a certain proper releasing angle, so that the vertical angle of the hand back support plate 12 is adjusted as shown by the dashed line of FIG. 6. As the ascending and descending plate 60 descends, the groove moving member 53 descends down to the concave portion 22 of the adjusting pin 20, and the horizontal angle adjusting hole 51 becomes free from the control of the adjusting pin 20. At this time, it is needed to properly adjust the horizontal direction of the intermediate plate 11 for a good release of the ball by moving the wrist, and then the pressed button 40 is released.

So, the ascending and descending plate 50 ascends by the elastic force of the ascending and descending spring 80, and the adjusting pin 20 is inserted into the fixing hole 52 of the horizontal angle adjusting hole 51 positioned at the adjusted horizontal angle, and the ascending and descending plate 50 allows the horizontal angle of the hand back support plate 12 as shown by the dotted line of FIG. 6 to be adjusted in accordance with a control of the adjusting pin 20.

The player of the bowling game memories the scales of the protrusion 62 passing through the adjusting hole 32 and the apex 21 passing through the smooth concave elongated hole 31, which scales correspond to the adjusted horizontal and vertical angles for a proper release of the ball. Later time, the player can easily adjust the horizontal and vertical angles of the hand back support plate 12 based on the memorized scales.

INDUSTRIAL APPLICABILITY

As described above, in the present invention, it is possible to concurrently adjust the horizontal and vertical angles of the hand back support plate 12 by simply pressing and releasing the button 40 for a good release of the ball. The manufacture cost is low, so that a customer may purchase the products at a lower price. A related industry of the bowling game may be developed. As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

SEQUENCE LIST TEXT adjusting pin, casing, button, ascending and descending plate, guide member, moving member

The invention claimed is:

1. A wrist protection device for a bowling game, comprising:

a wrist mounted plate in which an intermediate plate and a hand back support plate are connected at a front end of the wrist mounted plate using a pin;

an adjusting pin which includes an apex, a concave portion, and a support;

a casing which is attached to an upper surface of an intermediate plate using a bolt, with the intermediate plate being connected with the wrist mounted plate using the adjusting pin and includes a smooth concave elongated hole having scales on its upper surface, a plurality of button holes, and two ascending and descending grooves formed at both side surfaces;

a button which passes through an interior of the casing through the button hole and includes legs downwardly extending from its four corners, with each leg being provided with a groove and a distortion support; and an ascending and descending plate which is connected with a lower end of the leg in the interior of the casing and includes a horizontal angle adjusting hole having a plurality of fixing holes and groove moving part and two ascending and descending guides formed at both sides, wherein the apex is exposed to the outside through the smooth concave elongated support by passing the adjusting pin through the horizontal angle adjusting hole, and the ascending and descending spring is connected with each distortion support connected with the ascending and descending plate, so that the casing is attached to an upper surface of the intermediate plate using a bolt, and the horizontal angle adjusting hole becomes free from a control of the adjusting pin by descending the ascending and descending plate by pressing the button, whereby the horizontal angle of the hand back support plate is adjusted.

2. The device of claim 1, further comprising:

guide members which have engaging teeth formed at an inner side of a groove formed at the ascending and descending plate; and a moving member which slides between the guide members and includes a protrusion at an upper surface of the same, and moving engaging teeth formed at left and right side surfaces, wherein the moving member is disposed between the guide members and is provided with an elastic force of a straight spring, and the engaging teeth are escaped from the moving engaging teeth as the ascending and descending plate descends by pressing the button, and the moving member becomes free from the controls of the engaging teeth, so that the moving member is moved to a certain position proper for a good release of a bowling ball, whereby the vertical angle of the hand back support plate is adjusted.

* * * * *